US006418773B1

(12) United States Patent
Tolman

(10) Patent No.: US 6,418,773 B1
(45) Date of Patent: Jul. 16, 2002

(54) REBAR BENDER/CUTTER

(76) Inventor: Gerald L. Tolman, 12301 Gilbert St., Garden Grove, CA (US) 92841

( * ) Notice: Subject to any disclaimer, the term of this patent is extended or adjusted under 35 U.S.C. 154(b) by 0 days.

(21) Appl. No.: 09/792,458

(22) Filed: Feb. 23, 2001

(51) Int. Cl.[7] ..... B21J 13/08; B21D 7/024
(52) U.S. Cl. ..... 72/458; 72/218; 72/388
(58) Field of Search ..... 72/217, 218, 219, 72/387, 388, 458, 321, 294

(56) References Cited

U.S. PATENT DOCUMENTS

| | | | | | |
|---|---|---|---|---|---|
| 268,050 | A | * | 11/1882 | Stephens | 72/387 |
| 1,688,199 | A | * | 10/1928 | Meier | 72/217 |
| 2,127,185 | A | * | 8/1938 | Parker | 72/458 |
| 2,675,723 | A | * | 4/1954 | Stein | 72/458 |
| 3,732,721 | A | * | 5/1973 | Cusimano | 72/458 |
| 5,931,039 | A | * | 8/1999 | Yoshimizu et al. | 72/217 |
| 6,026,668 | A | * | 2/2000 | Oda et al. | 72/217 |

* cited by examiner

*Primary Examiner*—David Jones
(74) *Attorney, Agent, or Firm*—Stetina Brunda Garred & Brucker

(57) ABSTRACT

A rebar bender/cutter is disclosed for shaping and cutting rebar. The device includes a horizontal base having a connecting flange and supporting flange extending vertically therefrom. An arm receiving cam is rotatably engageable to the connecting flange and is has a plurality of arm receiving apertures formed therein for being alternately engageable to the arm. A bearing cam is engageable to the arm receiving cam and includes a bearing surface for abutting against the rebar. An urging member and supporting roller are provided to abut against an opposing surface of the rebar. Upon movement of the arm, the urging member bends the rebar as the bearing member translates through an arc to define the rebar curve diameter.

2 Claims, 3 Drawing Sheets

8

Fig. 4
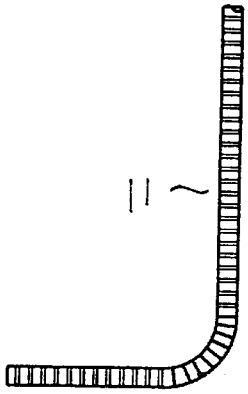
Fig. 3
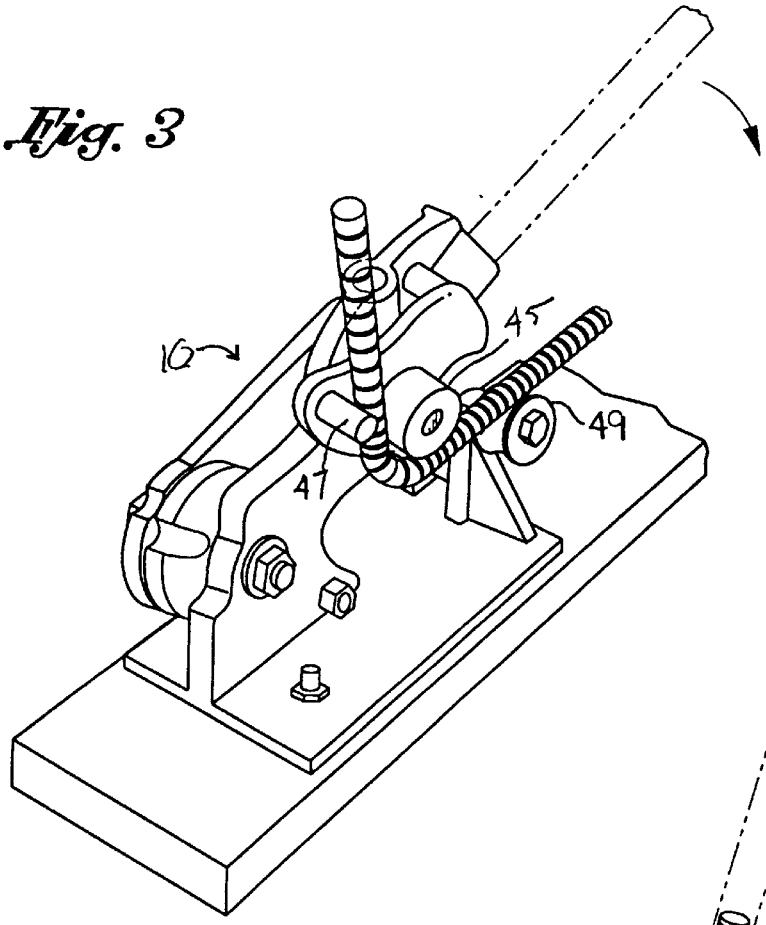
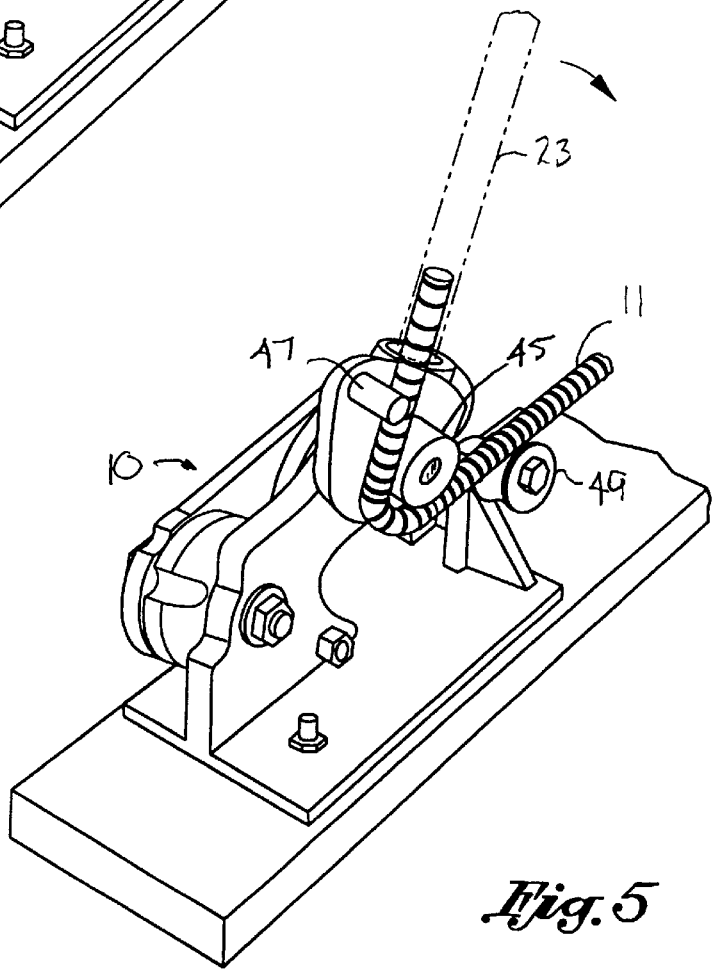
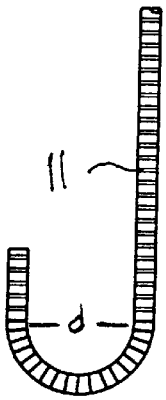
Fig. 6
Fig. 5

REBAR BENDER/CUTTER

CROSS-REFERENCE TO RELATED APPLICATIONS (Not Applicable)

STATEMENT RE: FEDERALLY SPONSORED RESEARCH/DEVELOPMENT (Not Applicable)

FIELD OF THE INVENTION

The present invention relates to a device that integrates the slot style rebar cutting design and the free handle bending designs. That device is the quarter circle slot on the handle assembly (cam). This quarter circle slot keeps the roller of the cutter blade in the slot during the bending of rebar over ninety degrees (90°) and up to one-hundred eighty degrees (180°).

No cutter/benders are known to employ both the slot for cutting, and the free handle full one-hundred eighty degrees (180°) bending without removing the rebar.

BACKGROUND OF THE INVENTION

Rebar is commonly used in various types of construction projects to provide strength to structural components. Rebar is commonly provided in fixed lengths, which are shaped and sized to accommodate the structure being formed. The shaping and sizing is done at the construction site as the form takes shape. Consequently, it is desirable to be able to easily shape and size a rebar to a variety of different configurations, within the practical limitations of a construction environment.

Contemporary devices exist for shaping and sizing rebar, though such devices have significant drawbacks. One such device is operative to shape the rebar to a curve of up to ninety degrees (90°) in a single motion of the device. Should it be necessary to curve the rebar more than ninety degrees (90°), the rebar must be disengaged from the device and then re-engaged in an alternate manner to permit bending beyond ninety degrees (90°), by a separate motion. The requirement for repositioning the rebar and initiating a further bending motion can be cumbersome in a construction environment. Rebar may be in lengths of eight feet (8 ft.) or more such that a ninety degree (90°) bend may produce an extended length of partially shaped material that may be awkward to reposition, and may be a hazard to the safety of others walking through the area. In order to facilitate the convenient, and safe. practice of shaping rebar more than ninety degrees (90°), there is a need for a device which avoids such limitations in contemporary devices.

Contemporary cutting devices also have common shortcomings. In one such device, cutting is effected by inserting the rebar through a central aperture in the bender/cutter. After the rebar is inserted into the aperture to the desired length, cutting. occurs. While such devices are effective to make cuts, the process is again cumbersome. The insertion of rebar into a small aperture in the device requires that the entire length of rebar be laid perpendicular to one side of the cutting device and maneuvered to insertion in a relatively small hole. That process is awkward, increases the clear space requirement required around the bender/cutter, and again raises safety concerns in relation to the construction workers moving through the area.

Accordingly, the existing need for a rebar bender/cutter which can bend rebar up to one hundred eighty degrees (180°), without requiring repositioning of the rebar on the bender. It is also desirable for a rebar bender/cutter to cut rebar without the need to move the entire length of the rebar to one side of the cutting device, and insert the rebar into a narrow aperture.

These and other objects and advantages are implemented by the invention as set forth more fully below.

BRIEF SUMMARY OF THE INVENTION

A rebar bender/cutter is disclosed for shaping and cutting rebar. The device includes a horizontal base having a connecting flange and supporting flange extending vertically therefrom. An arm receiving cam is rotatably engageable to the connecting flange and is has a plurality of arm receiving apertures formed therein for being alternately engageable to the arm. A bearing cam is engageable to the arm receiving cam and includes a bearing surface for abutting against the rebar. An urging member and supporting roller are provided to abut against an opposing surface of the rebar. Upon movement of the arm, the urging member bends the rebar as the bearing member translates through an arc to define the rebar curve diameter.

The device further includes a cutter pivot arm having a notch formed therein, adapted for alignment with a stationary notch connected to the connecting flange. Consequently, as the arm rotates, the notches move from an aligned position to a non-aligned position, causing cutting of any rebar disposed within the aligned notches.

In one embodiment, the notches are formed on a forward surface of the bender/cutter. However, it is anticipated that the notches may be disposed in other alternate locations.

The bending/cutting process may be implemented by engaging the arm to one or more of the arm receiving apertures. As presently envisioned, cutting at ninety degree (90°) bends may be implemented using one of the arm receiving apertures. If it is desirable to bend the rebar more than one-hundred eighty degrees (180°), the arm is preferably removed from the first arm receiving aperture, inserted into a second arm receiving aperture, and further rotated until the desired bend, i.e., up to one-hundred eighty degrees (180°), is effected.

BRIEF DESCRIPTION OF THE DRAWINGS

FIG. 3 shows the device of FIG. 1, wherein the rebar has been bent to approximately ninety degrees (90°);

FIG. 4 is a side view of the rebar as bent at FIG. 3;

FIG. 5 is an illustration of the device shown in FIG. 1, wherein the rebar is bent beyond ninety degrees (90°);

FIG. 6 is a side view of rebar bent to approximately one hundred eighty degrees (180°);

DETAILED DESCRIPTION OF THE INVENTION

The detailed description set forth below in connection with the drawings is intended as a description of the presently preferred embodiment of the invention, and is not intended to represent the only forms in which the present invention may be constructed or utilized. The description sets forth the functions and the sequence of the steps for constructing and operating the invention in connection with the illustrated embodiments. It is to be understood that the same or equivalent functions may be accomplished by different embodiments that are also intended to be encompassed within the scope of the invention.

Additional modifications and improvements of the present invention may also be apparent to those of ordinary skill in the art. Thus, the particular combination of parts described and illustrated herein is not intended to serve as limitations of alternative devices within the spirit and scope of the invention.

Figure 1:
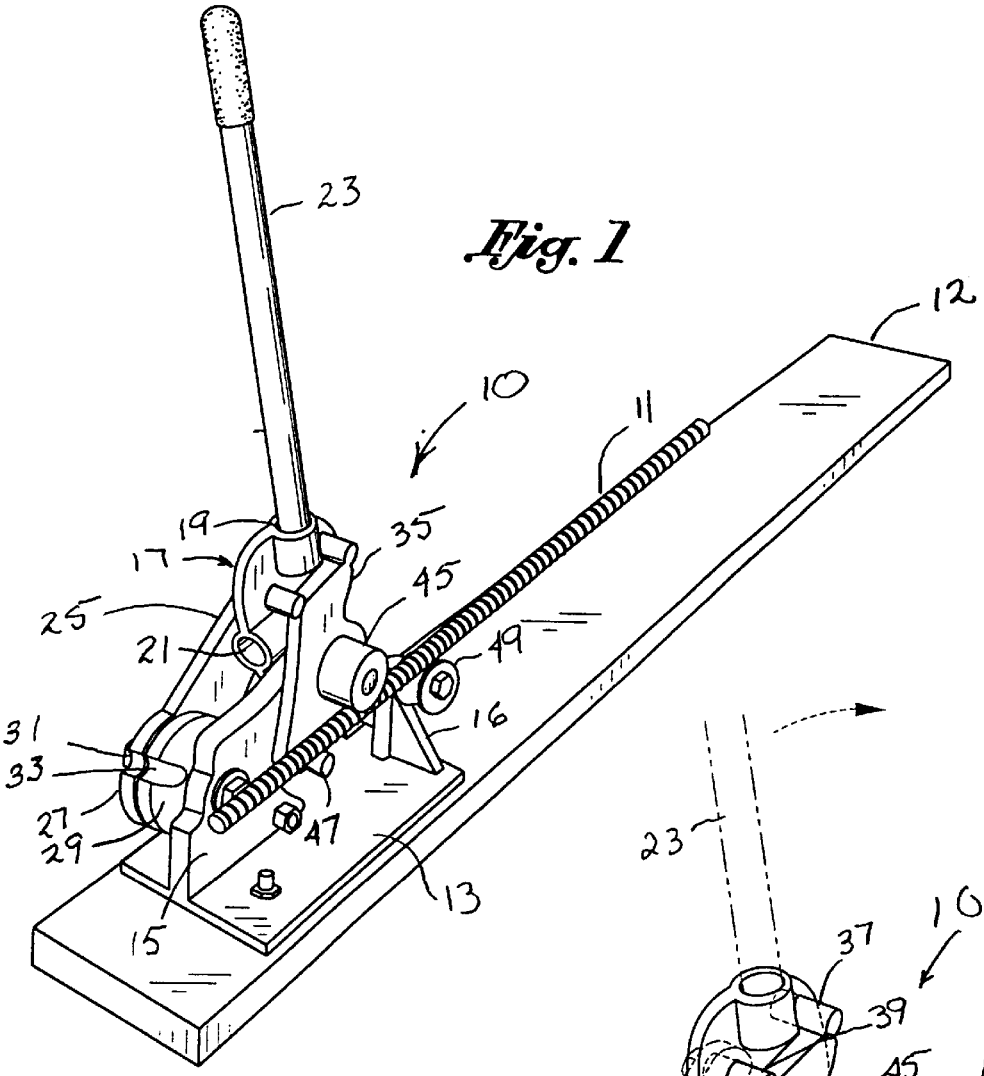
FIG. 1 is perspective view of one embodiment of the invention showing rebar in the initial pre-bending position.
Figure 2:
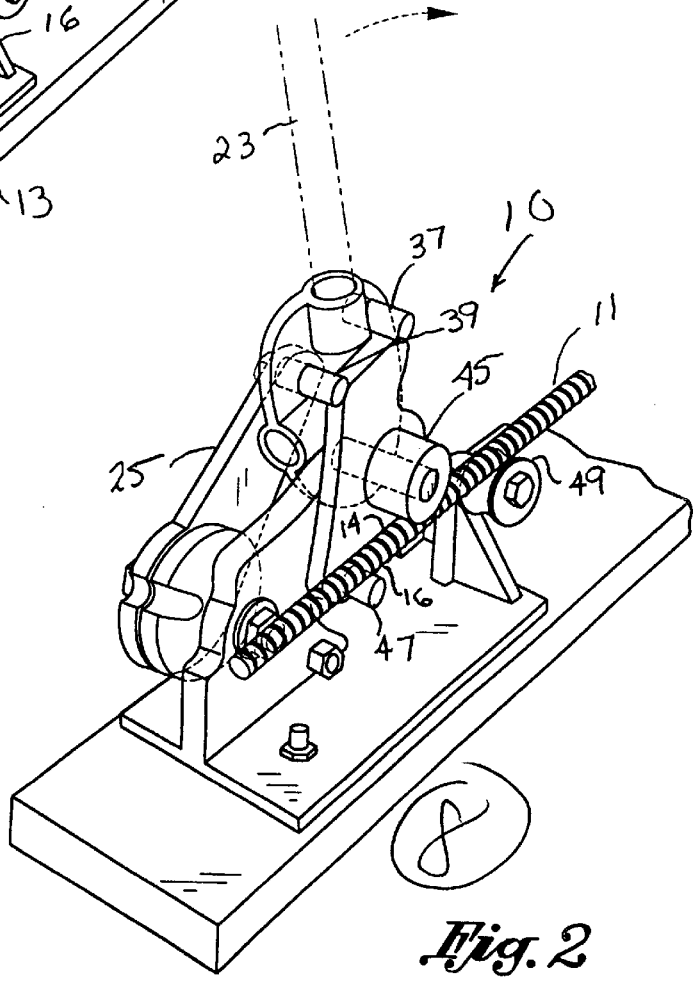
FIG. 2 is an enlarged view of a portion of FIG. 1, showing the engagement between portions of the bending/cutting device.

Referring to FIG. 1 bending/cutter device (10) shown mounted on backing board (12). Rebar (11) is disposed partially within device (10), as detailed below.

Device (10) includes a horizontal base (13), connecting flange (15) and supporting flange (16). In one embodiment the base (13) and flanges (15, 16) are formed as an integral piece, to which the remaining components of device (10) are secured.

Connecting flange (15) engages arm receiving cam (17), which includes arm receiving apertures (19, 21), for receiving arm (23).

Figure 7:
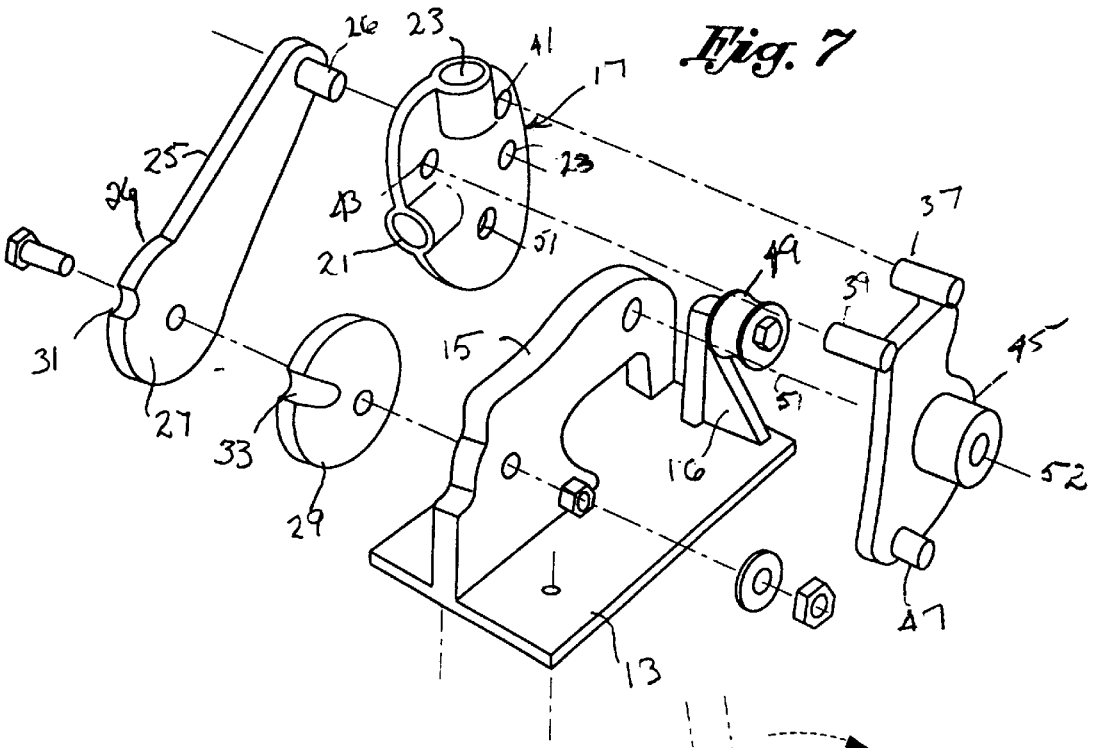
FIG. 7 is an exploded view of the device shown in FIG. 1.
Figure 8:
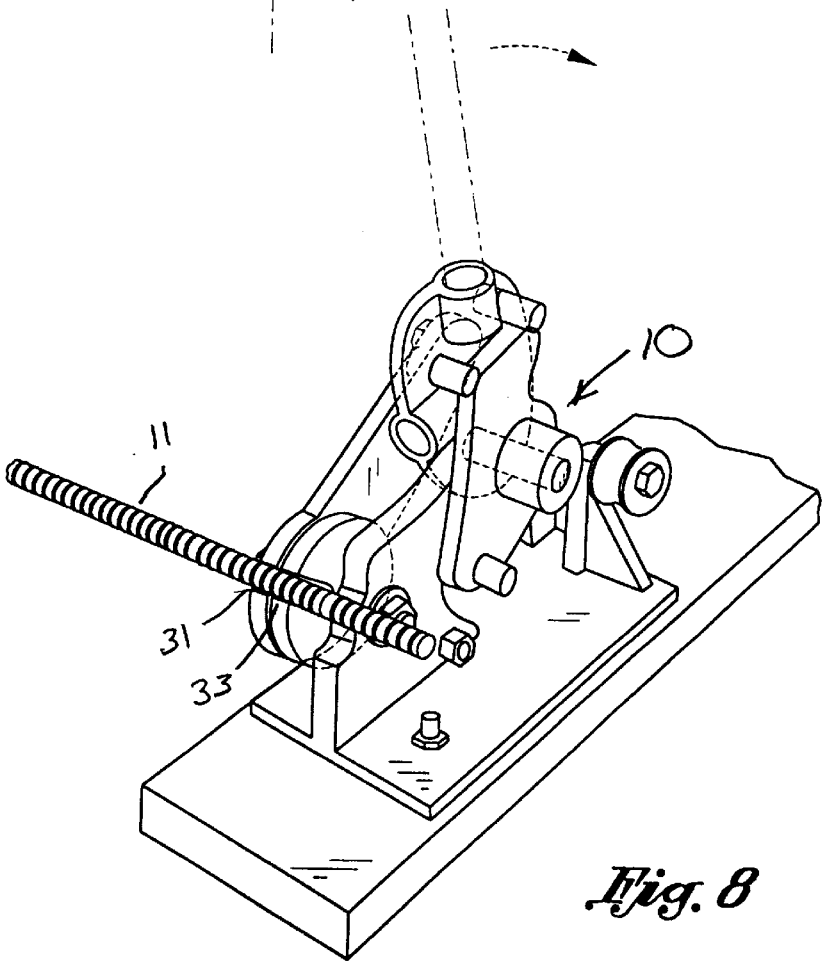
FIG. 8 is a view of the device shown in FIG. 1, illustrating the rebar cutting feature.

Cam (17) is also engaged to cutter pivot arm (25), by engagement of pivot arm protrusion (26) and aperture (28), (FIG. 7). Pivot arm (25) defines a cutter active portion (27) at one end (26) thereof. Cutter stationary portion (29) is disposed adjacent cutter active portion (27). Cutter active portion (27) and cutter stationary portion (29) define notches (31,33), for receiving rebar (11) during the cutting operation (FIG. 8).

Bearing cam (35) is disposed adjacent connecting flange (15) and, along with cam (17), is rotatable relative to the connecting flange (15). The bearing cam (35) defines a pair of protrusions (37,39), adapted to engage apertures (41, 43) of cam (17).

Bearing cam (35) further defines a cylindrical bend bearing surface (45), which in cooperation with urging member (47) and support roller (49) form a curve in the rebar (11) as arm (23) is rotated.

The rotation of arm (23) causes rotation of arm cam (17) about axis (51). As a result, urging member (47) and support roller (49) bear against one surface (16) and the bearing surface (45) bears against surface (14) of rebar (11). This causes rebar (11) to curve about bend bearing surface (45), as shown at FIGS. 3–6. Cylindrical bearing surface 45 is formed about access (52). Access (52) may be offset from access 51 such that rotation of arm (23) causes a migration of bearing surface (45) in an arced direction. The migration of bearing surface (45) facilitates curving rebar (11), as shown at FIGS. 4 and 6. More specifically, migration of bearing surface (45) defines the diameter d of the curved rebar, as shown at FIG. 6. The specific location of access (52), in relation to access (51), will define the diameter of the rebar curve. It has also been found that the migration of bearing surface (45) provides mechanical advantage to facilitate the bending of the rebar (11).

Rotation of arm (23) also causes cutter active portion (27) to rotate relative to cutter stationary portion (39), such that notches (31, 33) are moved from alignment, as shown at FIGS. 1 and 8, to non-alignment, as shown at FIGS. 3 and 5. As a result, rebar disposed within notches (31, 33) is cut along the line defined by the interface of notches (31, 33).

To bend the rebar (11) beyond ninety degrees (90°) arm (23) is retracted from aperture (19), and inserted into aperture (21), (FIG. 5). The arm is then rotated further as shown at FIG. 5, causing the rebar (11) to bend up to one hundred eighty degrees (180°), as shown at FIG. 6. Importantly, the bending of the rebar (11), from a straight position to one hundred eighty degrees (180°), is effected without removing the rebar (11) from its engagement to the device (10).

Also importantly, as explained above, the cutting operation of device (10) is effected by engaging the rebar (11) to device (10) only in the region where the cut is to be formed. The rebar (11) need not be moved to entirely one side of device (10) and inserted into the device (10) until the region to be cut is in place.

As will be apparent to one of ordinary skill in the art, various modifications may be made to the invention, without departing from the broader features thereof, and as claimed below.

What is claimed is:

1. A rebar bender for shaping rebar comprising:

a) a horizontal base having a connecting flange and a supporting flange extending vertically therefrom;

b) an arm receiving cam rotatably engaged to the connecting flange, the arm receiving cam having a plurality of arm receiving apertures formed therein;

c) at least one arm alternately engageable to one of the arm receiving apertures for rotating the arm receiving cam;

d) a bearing cam engageable to the arm receiving cam, the bearing cam having a bearing surface for abutting against a first surface of the rebar;

e) the bearing cam further defining an urging member spaced from the bearing surface for bearing against a second surface of the rebar;

f) a supporting roller disposed on said supporting flange for supporting the second surface of the rebar;

g) the urging member being translatable upon movement of the arm to curve the rebar against the bearing surface; and h) wherein the bearing member migrates in response to rotation of the arm to define a curve in the rebar.

2. A rebar bender/cutter for shaping and cutting rebar comprising:

a) a horizontal base having a connecting flange and a supporting flange extending vertically therefrom;

b) an arm receiving cam rotatably engaged to the connecting flange, the arm receiving cam having a plurality of arm receiving apertures formed therein;

c) at least one arm alternately engageable to one of the arm receiving apertures for rotating the arm receiving cam;

d) a bearing cam engageable to the arm receiving cam, the bearing cam having a bearing surface for abutting against a first surface of the rebar;

e) the bearing cam further defining an urging member spaced from the bearing surface for bearing against a second surface of the rebar;

f) a supporting roller disposed on said supporting flange for supporting the second surface of the rebar;

g) the urging member being translatable upon movement of the arm to curve the rebar against the bearing member;

h) wherein the bearing member migrates in response to rotation of the arm to define a curve in the rebar;

i) a cutter stationary portion engageable to the connecting flange, the cutter stationary portion defining a first notch formed in the outer surface thereof;

j) a cutter pivot arm having the cutter active portion defining a second notch therein; and k) the cutter pivot arm being connectible to the arm receiving cam and the cutter stationary portion such that, upon movement of the arm, the second cutting notch moves from a position in substantial alignment with said first notch, to a position of non-alignment with said first notch, causing cutting of rebar disposed within the first and second notches.

* * * * *